US011499261B2

(12) United States Patent
Lee et al.

(10) Patent No.: US 11,499,261 B2
(45) Date of Patent: Nov. 15, 2022

(54) WASHING MACHINE

(71) Applicant: LG Electronics Inc., Seoul (KR)

(72) Inventors: Junghoon Lee, Seoul (KR); Kyungchul Woo, Seoul (KR); Jaehyun Kim, Seoul (KR); Myunghun Im, Seoul (KR); Hwanjin Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 44 days.

(21) Appl. No.: 16/235,789

(22) Filed: Dec. 28, 2018

(65) Prior Publication Data

US 2019/0203405 A1 Jul. 4, 2019

(30) Foreign Application Priority Data

Dec. 28, 2017 (KR) ..... 10-2017-0182265

(51) Int. Cl.
*D06F 37/26* (2006.01)
*D06F 39/08* (2006.01)
*D06F 23/06* (2006.01)

(52) U.S. Cl.
CPC ..... *D06F 37/266* (2013.01); *D06F 23/06* (2013.01); *D06F 39/083* (2013.01);
(Continued)

(58) Field of Classification Search
CPC ..... D06F 37/266; D06F 37/20; D06F 37/203; D06F 39/08–088
See application file for complete search history.

(56) References Cited

U.S. PATENT DOCUMENTS 5,404,732 A * 4/1995 Kim ..... D06F 35/001 68/183
5,906,056 A * 5/1999 Noguchi ..... D06F 37/225 34/596

(Continued)

FOREIGN PATENT DOCUMENTS

AU 2018260955 5/2019
CN 1167852 12/1997

(Continued)

OTHER PUBLICATIONS

Extended European Search Report in European Application No. 18215056.5, dated May 15, 2019, 9 pages.

(Continued)

*Primary Examiner* — Spencer E. Bell
*Assistant Examiner* — Omair Chaudhri
(74) *Attorney, Agent, or Firm* — Fish & Richardson P.C.

(57) ABSTRACT

A washing machine includes a casing, a tub, a drum, a pump, a gasket that is arranged between a case opening and a tub opening and that includes first nozzles and second nozzles, and a water pipe assembly that includes: first nozzle ports affixed to the first nozzles, second nozzle ports affixed to the second nozzles, a first conduit, and a second conduit. The gasket further includes port insertion pipes into which the first and second nozzle ports are inserted. Each of the first and second nozzle ports includes at least one press-fit protrusion that is formed on an outer circumferential surface of the nozzle supply port and that is configured to, in a state in which the nozzle supply port is inserted into a corresponding port insertion pipe, maintain contact with an inner circumferential surface of the port insertion pipe.

22 Claims, 9 Drawing Sheets

(52) U.S. Cl.
CPC ..... *D06F 39/088* (2013.01); *D06F 37/265* (2013.01); *D06F 39/085* (2013.01)

(56) References Cited

U.S. PATENT DOCUMENTS

| | | | | |
|---|---|---|---|---|
| 5,931,184 | A * | 8/1999 | Armenia | A47L 15/421 285/123.1 |
| 9,222,210 | B2 * | 12/2015 | Lee | D06F 37/266 |
| 9,903,066 | B2 * | 2/2018 | Lim | D06F 23/04 |
| 2006/0191077 | A1 * | 8/2006 | Oh | D06F 33/47 68/12.22 |
| 2009/0249838 | A1 | 10/2009 | Kim et al. | |
| 2009/0249840 | A1 * | 10/2009 | Jo | D06F 39/083 68/5 C |
| 2011/0083477 | A1 * | 4/2011 | Kim | D06F 37/266 68/140 |
| 2014/0033449 | A1 * | 2/2014 | Im | D06F 33/34 8/137 |
| 2014/0311189 | A1 * | 10/2014 | Im | D06F 33/34 68/12.01 |
| 2014/0352363 | A1 * | 12/2014 | Kim | D06F 37/266 239/600 |
| 2016/0029871 | A1 | 2/2016 | Kim et al. | |
| 2017/0211223 | A1 | 7/2017 | Cho et al. | |
| 2017/0356119 | A1 | 12/2017 | Favaro et al. | |
| 2018/0347099 | A1 * | 12/2018 | Zhang | D06F 39/02 |
| 2019/0112748 | A1 * | 4/2019 | Lee | D06F 39/085 |
| 2019/0136438 | A1 * | 5/2019 | Lee | D06F 39/006 |
| 2019/0323162 | A1 * | 10/2019 | Jung | D06F 37/30 |
| 2019/0330780 | A1 * | 10/2019 | Jung | D06F 37/266 |
| 2020/0141045 | A1 * | 5/2020 | Seo | D06F 39/088 |

FOREIGN PATENT DOCUMENTS

| | | | | |
|---|---|---|---|---|
| CN | 1106474 | | 4/2003 | |
| CN | 101925699 | | 12/2010 | |
| CN | 102121186 | | 7/2011 | |
| CN | 102482833 | | 5/2012 | |
| CN | 102575412 | | 7/2012 | |
| CN | 102639776 | | 8/2012 | |
| CN | 103147254 | | 6/2013 | |
| CN | 103547726 | | 1/2014 | |
| CN | 103562458 | | 2/2014 | |
| CN | 103562459 | | 2/2014 | |
| CN | 103562460 | | 2/2014 | |
| CN | 103774381 | | 5/2014 | |
| CN | 110352274 | | 10/2019 | |
| DE | 102014106766 | | 11/2015 | |
| EP | 2138625 | | 12/2009 | |
| EP | 2631349 | | 8/2013 | |
| EP | 2719814 | A1 * | 4/2014 | D06F 37/266 |
| EP | 2719841 | A1 * | 4/2014 | E03C 1/108 |
| EP | 2719814 | | 4/2016 | |
| EP | 2631349 | B1 * | 4/2017 | D06F 39/083 |
| EP | 2471993 | B1 * | 10/2019 | D06F 39/083 |
| ES | 2446115 | B1 * | 3/2015 | D06F 39/088 |
| JP | 2006239142 | | 9/2006 | |
| JP | 2011250920 | | 12/2011 | |
| WO | WO2011053091 | | 5/2011 | |
| WO | WO2014037840 | | 3/2014 | |
| WO | WO2014038940 | | 3/2014 | |
| WO | WO2014195913 | | 12/2014 | |
| WO | WO2017155309 | | 9/2017 | |
| WO | WO2018124786 | | 7/2018 | |

OTHER PUBLICATIONS

Australian Office Action in Australian Application No. 2019200008, dated Jun. 13, 2019, 12 pages.
Chinese Office Action in Chinese Application No. 201811623462.3, dated Sep. 28, 2020, 22 pages (with English translation).
AU Office Action in Australian Appln. No. 2020223688, dated Apr. 19, 2021, 7 pages.
CN Office Action in Chinese Appln. No. 201811623462.3, dated Apr. 8, 2021, 19 pages (with English translation).

* cited by examiner

WASHING MACHINE

CROSS-REFERENCE TO RELATED APPLICATIONS

This application claims the benefit of an earlier filing date and right of priority to Korean Patent Application No. 10-2017-0182265, filed on Dec. 28, 2017, in the Korean Intellectual Property Office, the disclosure of which is herein incorporated by reference in its entirety.

TECHNICAL FIELD

The present invention relates to a washing machine having a nozzle which sprays water that is discharged from a tub and circulated along a circulation conduit to a drum.

BACKGROUND

Generally, a washing machine is an apparatus that separates contaminants from clothing, bedding, etc. (hereinafter, referred to as "laundry") by using chemical decomposition of water and detergent and physical action such as friction between water and laundry.

Such a washing machine includes a tub containing water and a drum rotatably installed in the tub to accommodate the laundry. A recent washing machine is configured to circulate water discharged from the tub by using a circulation pump and to spray the circulated water into the drum through a nozzle. However, since such a conventional washing machine usually includes a single or two nozzles, in the case where not only the single nozzle is provided but also two nozzles are provided, the spraying direction is limited, so that the laundry cannot be soaked evenly. In particular, in recent years, although new technologies for controlling the rotation of the drum have been developed in order to impart variety to the flow of laundry introduced into the drum, there is a limit in that a remarkable improvement in performance cannot be expected with a conventional structure.

In addition, in the conventional washing machine, a circulation conduit is connected to the circulation pump, and water pumped by the circulation pump is guided along the circulation conduit, and the guided water is supplied again to the nozzle through a connector that connects the nozzle and the circulation conduit. However, conventionally, when two nozzles are provided, two circulation conduits connected to the circulation pump and two nozzle water supply conduits respectively connected to the two circulation conduits are required, so that the structure of the product is complicated and the manufacturing process of the product was troublesome due to the process of assembling the circulation conduits and the nozzle water supply conduits.

In addition, since there are many connection portions between the circulation conduit, the nozzle water supply conduits, and the nozzles, there is a possibility that water leaks from the connection portions during operation of the washing machine. Particularly, since the outer circumferential surface of the nozzle water supply conduit is wetted by the circulating water sprayed from the nozzle, there is a hygiene problem due to the coagulation of the detergent contained in the circulating water and the deposition of contaminants.

In order to solve such a problem, a technology that a nozzle and a nozzle water supply conduit are installed in a gasket connecting a laundry input port formed on the front surface of a casing and an opening formed on the front surface of the tub, and the fluid introduced into the circulation pump from the tub is sprayed into the drum through the nozzle water supply conduit is actively under development.

However, when the nozzle and the nozzle water supply conduit are installed in the gasket, a binding member is used to fix the nozzle water supply conduit to the gasket. However, since a worker should tighten the binding member one by one, the time required for the operation is increased.

In addition, since the portion of the gasket covered by the binding member should protrude to the outside of the gasket more than the width of the binding member, when the nozzle water supply conduit is coupled to the gasket, it has to be bent due to the amount of protrusion of the portion covered by the binding member, so that flow resistance of the fluid flowing through the nozzle water supply conduit is generated and, consequently, water cannot be uniformly sprayed into the drum from the nozzle.

SUMMARY

A first object to be solved by the present invention is to provide a washing machine capable of reducing a time required for the operation of coupling a nozzle water supply conduit to a gasket by press-fitting the nozzle water supply conduit for guiding water pumped from a pump to a nozzle into the gasket.

A second object to be solved by the present invention is to provide a washing machine capable of reducing the flow resistance of fluid flowing through the nozzle water supply conduit.

A third object to be solved by the present invention is to provide a washing machine in which the spray shape of water sprayed into a drum from a plurality of nozzles can be maintained uniformly without being affected by gravity.

A fourth object to be solved by the present invention is to provide a washing machine capable of preventing the nozzle water supply conduit from being separated from the gasket.

These objects are achieved with the features of the claims.

In accordance with an aspect of the present invention, a washing machine includes: a casing having an input port, formed on a front surface thereof, through which laundry is inputted; a tub which is disposed in the casing to contain fluid, and has an opening, formed on a front surface thereof, which communicates with the input port; a drum which is rotatably disposed in the tub, and contains the laundry; a pump which pumps water discharged from the tub; a gasket which communicates the input port and the opening of the tub, and has a plurality of nozzles, provided in an inner circumferential portion thereof, for spraying water into the drum; and a nozzle water supply conduit which guides the water pumped by the pump to the plurality of nozzles, wherein the nozzle water supply conduit includes: a transfer conduit which is disposed in an outer circumference of the gasket, and into which the water pumped by the pump flows;

and a plurality of nozzle water supply ports which are protruded from the transfer conduit and supply water guided through the transfer conduit to the plurality of nozzles, wherein a plurality of port insertion conduits into which the plurality of nozzle water supply ports are respectively inserted are formed in the gasket, wherein a press-fit protrusion being in close contact with an inner circumferential surface of the plurality of port insertion conduits is formed in an outer circumferential surface of each of the plurality of nozzle water supply ports.

The press-fit protrusion is formed in a ring shape extending along a circumferential direction on the outer circumferential surface of the nozzle water supply port.

A plurality of press-fit protrusions are formed along a longitudinal direction of the nozzle water supply port.

The press-fit protrusion includes: a first surface which is protruded outward along a radial direction from an outer circumference of the nozzle water supply port to a certain point, and is perpendicular to the outer circumference of the nozzle water supply port; and a second surface which is extended from the certain point to an outlet side of the nozzle water supply port, and is extended closer to the outer circumference of the nozzle water supply port.

Each of the plurality of nozzles includes: a nozzle inflow conduit which communicates with the port insertion conduit and is protruded to the inside of the gasket; and a nozzle head which is connected to the nozzle inflow conduit and forms an outlet for spraying water into the drum, wherein the nozzle head faces an outlet of the nozzle inflow conduit, and has a collision surface that is formed to be inclined toward the center of the gasket.

The nozzle inflow conduit includes: an inlet portion which is extended by a certain length with the same diameter as an inlet of the port insertion conduit, from the inlet of the port insertion conduit into which the nozzle water supply port is inserted; and an outlet portion which connects the inlet portion and the nozzle head, and has a diameter that is gradually decreased from the inlet portion toward the nozzle head.

The washing machine further includes a circulation conduit for guiding the water pumped by the pump, wherein the nozzle water supply conduit further includes a circulation conduit connection port connected to the circulation conduit, wherein the transfer conduit includes: a first conduit which extends in a first direction from the circulation conduit connection port and is connected to any two or more nozzle water supply ports of the plurality of nozzle water supply ports; and a second conduit which extends in a second direction from the circulation conduit connection port and is connected to the other two or more nozzle water supply ports of the plurality of nozzle water supply ports, wherein one end of each of the first conduit and the second conduit is fluid-connected to the circulation conduit connection port, and the other end of the first conduit and the other end of the second conduit are respectively closed.

The washing machine further includes at least one balancer which is disposed along a circumference of the opening of the tub and has a certain weight, wherein the transfer conduit is disposed between the gasket and the at least one balancer.

The plurality of nozzle water supply ports includes: a pair of upper nozzle water supply ports which are positioned below the closed other ends of the first conduit and the second conduit, and disposed in both left and right sides respectively based on the circulation conduit connection port; and a pair of lower nozzle water supply ports which are disposed below the pair of upper nozzle water supply ports, and disposed in both left and right sides respectively based on the circulation conduit connection port.

The at least one balancer is provided with a separation preventing rib protruded from a position corresponding to the pair of upper nozzle water supply ports to prevent separation of the pair of upper nozzle water supply ports.

The transfer conduit includes a protrusion which is formed in a position corresponding to the pair of lower nozzle water supply ports and is convexly formed toward the at least one balancer.

The plurality of nozzles includes: a pair of upper nozzles which are disposed above a center of the gasket, and are disposed in both sides based on an inlet port of the transfer conduit into which the water supplied by the pump flows; and a pair of lower nozzles which are disposed below the center of the gasket and disposed above the inlet port, and disposed in both sides respectively based on the inlet port.

The plurality of port insertion conduits are protruded from an outer circumferential surface of the gasket.

BRIEF DESCRIPTION OF THE DRAWINGS

The objects, features and advantages of the present invention will be more apparent from the following detailed description in conjunction with the accompanying drawings, in which.

DETAILED DESCRIPTION

Hereinafter, a washing machine according to an embodiment of the present invention will be described with reference to the drawings.

Figure 1:
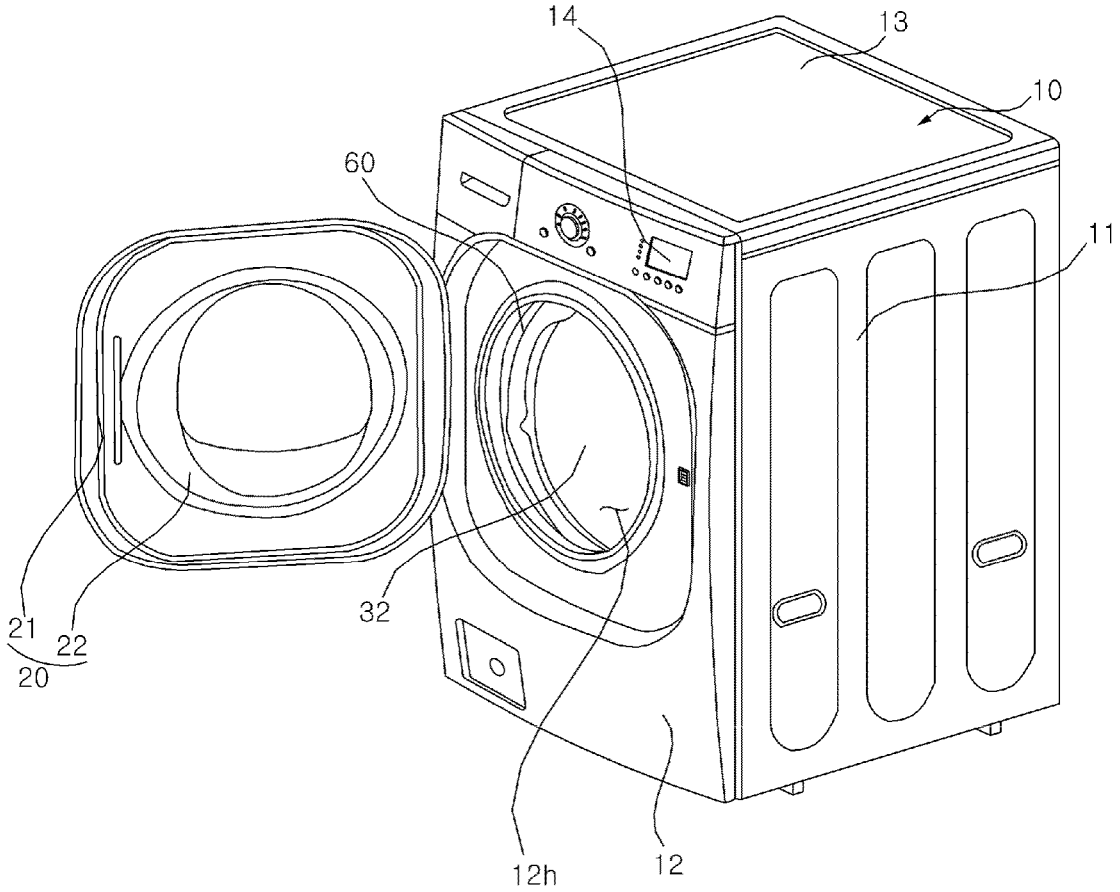
FIG. 1 is a perspective view illustrating a washing machine according to an embodiment of the present invention.
Figure 2:
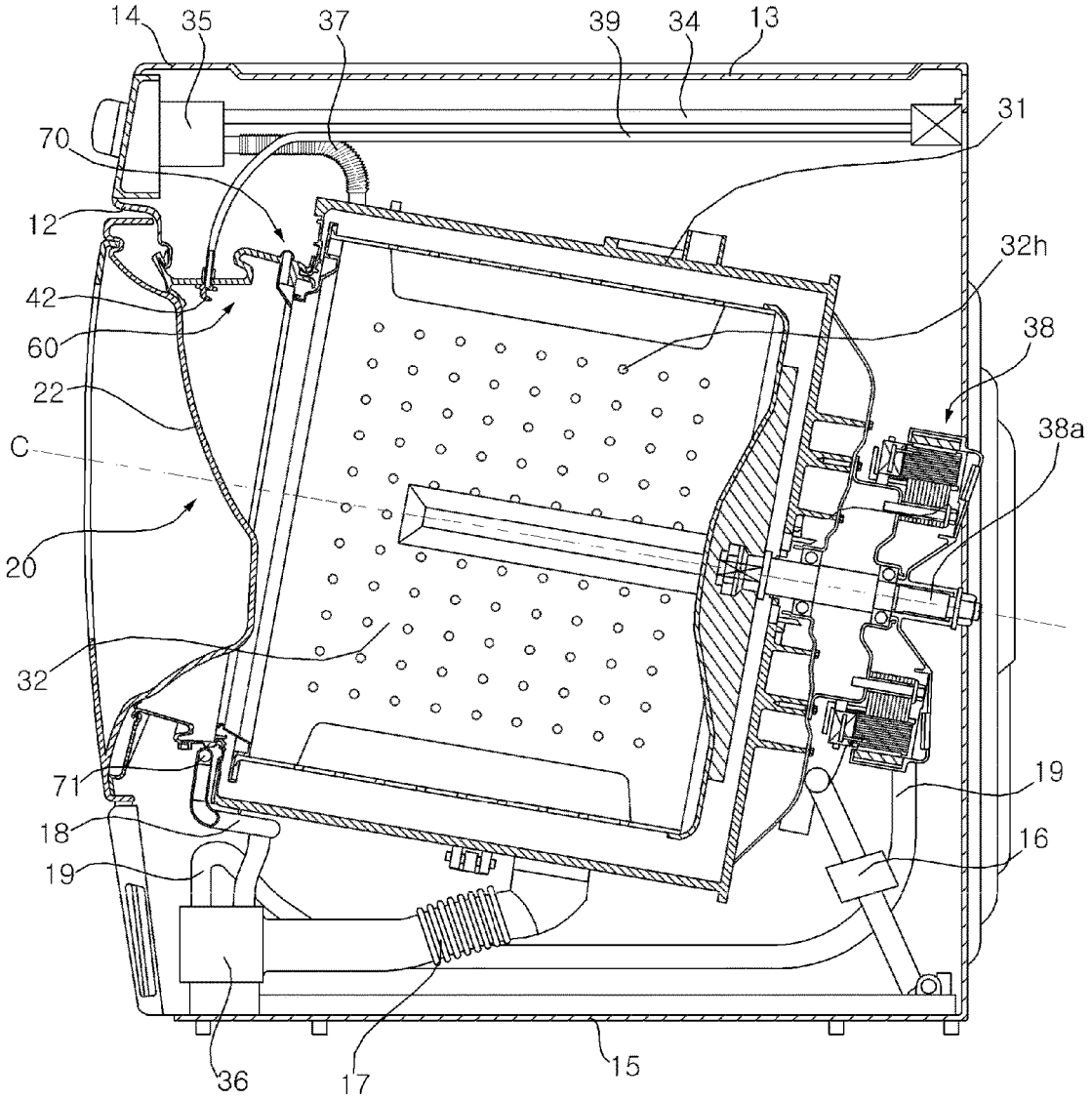
FIG. 2 is a side sectional view of the washing machine shown in FIG. 1.

FIG. 1 is a perspective view illustrating a washing machine according to an embodiment of the present invention, and FIG. 2 is a side sectional view of the washing machine shown in FIG. 1.

Referring to FIG. 1 and FIG. 2, a washing machine according to an embodiment of the present invention includes a casing 10 forming an outer appearance. The casing 10 is provided with an input port **12*h*, formed on a front surface thereof, through which laundry is inputted. The casing 10 includes a cabinet 11 having an opened front surface, a left surface, a right surface, and a rear surface, and a front panel 12 which is coupled to the opened front surface of the cabinet 11 and on which the input port 12*h* is formed. A bottom surface and an upper surface of the cabinet 11 are opened, and a horizontal base 15 supporting the washing machine may be coupled to the bottom surface. In addition, the casing 10 may further include a top plate 13 covering an open top surface of the cabinet 11 and a control panel 14 disposed on the top side of the front panel 12**.

In the casing 10, a tub 31 containing water may be disposed. The tub 31 has an opening formed at the front surface thereof so that the laundry can be inputted, and the opening communicates with the input port **12*h* formed in the casing 10 by a gasket 60**.

A door 20 for opening and closing the input port **12*h* may be rotatably coupled to the casing 10. The door 20 may include a door frame 21 which is opened at a roughly central portion and is rotatably coupled to the front panel 12, and a transparent window 22 provided at the opened central portion of the door frame 21**.

The gasket 60 serves to prevent water contained in the tub 31 from leaking. A front end portion is coupled with the front surface (or the front panel 12) of the casing 10, a rear end portion is coupled with the circumference of the opening of the tub 31, and a gap between the front end portion and the rear end portion are extended in a cylindrical shape. The gasket 60 may be made of a flexible or resilient material. The gasket 60 may be made of natural rubber or synthetic resin.

Hereinafter, a portion defining the inside of the cylindrical shape of the gasket 60 is referred to as an inner circumferential portion (or an inner circumferential surface) of the gasket 60, and an opposite portion is referred to as an outer circumferential portion (or an outer circumferential surface) of the gasket 60.

A drum 32 in which laundry is accommodated may be rotatably provided in the tub 31. The drum 32 accommodates the laundry, and an inlet of the drum 32 through which the laundry is inputted is disposed on the front surface of the drum 32, and the drum 32 is rotated around a roughly horizontal rotation center line C. However, here, the "horizontal" is not a term used as a mathematically strict sense. That is, as in the embodiment, since it is also close to horizontal when the rotation center line C is inclined at a certain angle (e.g., 5 degrees or less) with respect to the horizontal, it may be considered to be roughly horizontal. A plurality of through holes 32*h* may be formed in the drum 32 so that water in the tub 31 can be introduced into the drum 32.

A driving unit 38 for rotating the drum 32 may be further provided, and a drive shaft 38*a* rotated by the driving unit 38 may be coupled with the drum 32 through a rear portion of the tub 31.

Preferably, the driving unit 38 includes a direct-coupled motor, and the motor includes a stator fixed to the rear of the tub 31 and a rotor rotated by magnetic force acting with the stator. The drive shaft 38*a* may be rotated integrally with the rotor.

The tub 31 may be supported by a damper 16 provided in the base 15. The vibration of the tub 31 caused by the rotation of the drum 32 is attenuated by the damper 16. Although not shown, according to the embodiment, a hanger (e.g., a spring) for hanging the tub 31 in the casing 10 may be further provided.

At least one water supply hose (not shown) for guiding water supplied from an external water source such as a faucet to the tub 31, and a water supply unit 33 for interrupting the at least one water supply hose.

A dispenser 35 for supplying an additive such as a detergent, a fabric softener or the like into the tub 31 or the drum 32 may be provided. In the dispenser 35, the additives may be classified and accommodated according to their kinds. The dispenser 35 may include a detergent accommodating portion (not shown) for accommodating the detergent and a softening agent accommodating portion (not shown) for accommodating the fabric softener.

At least one water supply conduit 34 for selectively guiding the water supplied through the water supply unit 33 to the respective accommodating portions of the dispenser 35 may be provided. The water supply unit 33 may include at least one water supply valve 94 for interrupting each water supply conduit 34.

The at least one water supply conduit 34 may include a first water supply conduit for supplying water to the detergent accommodating portion and a second water supply conduit for supplying water to the softening agent accommodating portion. In this case, the at least one water supply valve may include a first water supply valve for interrupting the first water supply conduit and a second water supply valve for interrupting the second water supply conduit.

Meanwhile, the gasket 601 may be provided with a direct water nozzle 42 for spraying water into the drum 32, and a direct water supply conduit 39 for guiding the water supplied through the water supply unit 33 to the direct water nozzle 42. The water supply unit 33 may include a third water supply valve for interrupting the direct water supply conduit 39.

The water discharged from the dispenser 35 is supplied to the tub 31 through a water supply bellows 37. A water supply port (not shown) connected to the water supply bellows 37 may be formed in the tub 31.

The tub 31 is provided with a drain port for discharging water, and a drain bellows 17 may be connected to the drain port. A pump 36 for pumping water discharged from the tub 31 through the drain bellows 17 may be provided.

The pump 36 may perform the function of pumping the water discharged from the tub 31 through the drain bellows 17 to a drain conduit 19, and to a circulation conduit 18 selectively. Hereinafter, the water that is pumped by the pump 36 and guided along the circulation conduit 18 is referred to as circulating water.

The pump 36 may include an impeller (not shown) for pumping water, a pump housing (not shown) for accommodating the impeller, and a pump motor (not shown) for rotating the impeller. The pump housing may be provided with an inlet port (not shown) through which water is introduced through the drain bellows 17, a drain discharge port (not shown) through which the water pumped by the impeller is discharged to the drain conduit 19, and a circulating water discharge port (not shown) for discharging the water pumped by the impeller to the circulation conduit 18.

The pump motor may be capable of accomplishing forward/reverse rotation. Depending on the direction in which the impeller is rotated, water may be discharged through the drain discharge port or water may be discharged through the circulating water discharge port. Such a configuration may be implemented by appropriately designing the structure of the pump housing. Since such a technology is well known in Korean Patent Laid-Open Publication No. 10-2013-0109354, a detailed description thereof will be omitted.

The circulation conduit 18 guides the water pumped by the circulation pump. An inlet of the circulation conduit 18 is connected to the circulating water discharge port, and an outlet of the circulation conduit 18 is connected to a nozzle water supply conduit 70 described later. However, the present invention is not limited to this, and a circulation pump for pumping the water discharged from the tub 31 to the circulation conduit 18 and a drain pump for pumping the water discharged from the tub 31 to the drain conduit 19 may be separately provided. Under the control of a controller (not shown) described later, the circulation pump may be operated (e.g., during washing), or the drain pump may be operated (e.g., during draining) according to a certain algorithm.

Meanwhile, the flow rate (or discharge water pressure) of the pump 36 is variable. To this end, the pump motor constituting the pump 36 may be a variable speed motor capable of controlling the rotation speed. The pump motor may preferably be a brushless direct current (BLDC) motor, but is not limited thereto. A driver for controlling the speed of the motor may be further provided, and the driver may be an inverter driver. The inverter driver converts AC power to DC power and inputs the converted DC power to the motor at a target frequency.

A controller for controlling the pump motor may be further provided. The controller may include a proportional-integral controller (PI controller), a proportional-integral-derivative controller (PID controller), and the like. The controller may receive an output value of the pump motor (e.g., output current) as an input, and control the output value of the driver so that the rotational speed of the pump motor follows a preset target rotational speed based on the received input.

Meanwhile, it is to be understood that the controller can control not only the pump motor but also the entire operation of the washing machine, and that the control of each unit mentioned below is achieved by the controller.

Figure 3:
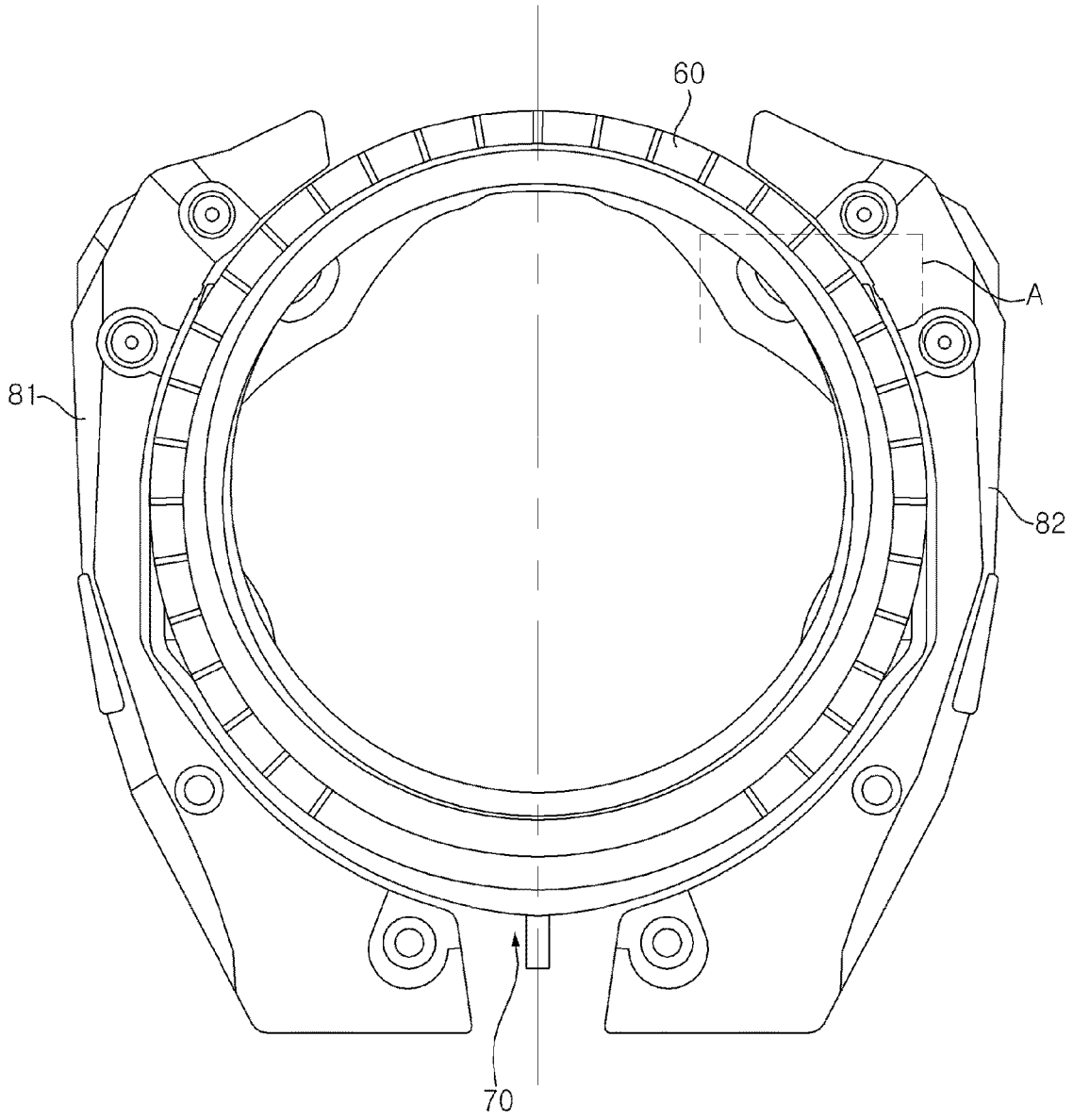
FIG. 3 is a view illustrating a part of the washing machine shown in FIG. 1.

FIG. 3 is a view illustrating a part of the washing machine shown in FIG. 1.

Referring to FIG. 3, a balancer 81, 82 is disposed on the front surface of the tub 31 along the circumference of the opening of the tub 31. The balancer 81, 82 serves to reduce the vibration of the tub 31, and has a certain weight. A plurality of balancers 81 and 82 may be provided, and may include a first balancer 81 positioned in the left side and a second balancer 82 positioned in the right side when viewed from the front portion of the tub 31. However, the number and position of the balancers 81 and 82 may be variously changed, and at least one balancer 81, 82 may be provided.

The nozzle water supply conduit 70 may be provided on the outer circumferential surface of the gasket 60. The upper portion of the nozzle water supply conduit 70 may be opened and may cover the outer circumferential surface of the gasket excluding the upper portion thereof. The nozzle water supply conduit 70 may be positioned between the gasket 60 and at least one balancer 81, 82.

Figure 4:
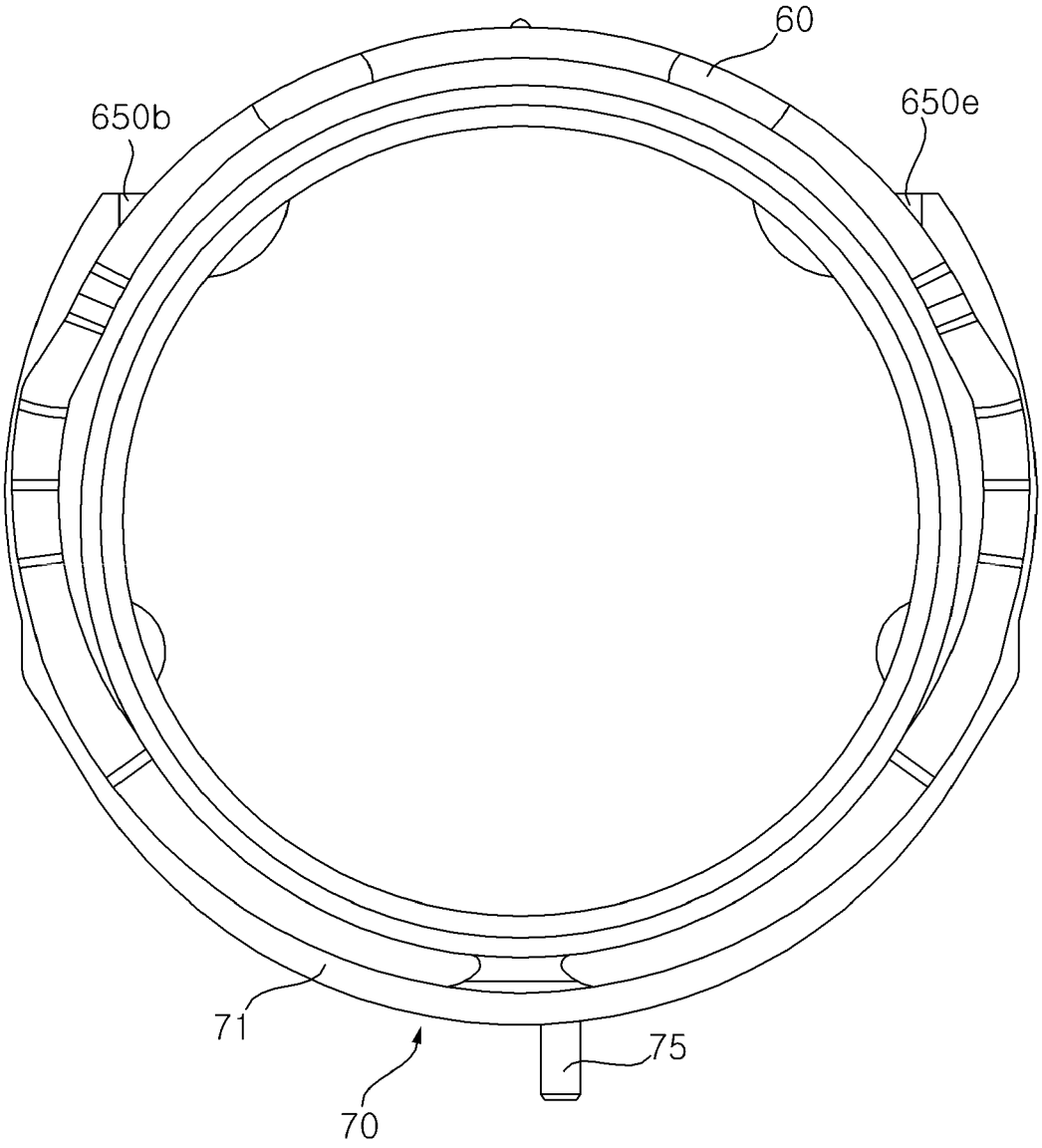
FIG. 4 is a view excluding a balancer in FIG. 3.
Figure 5:
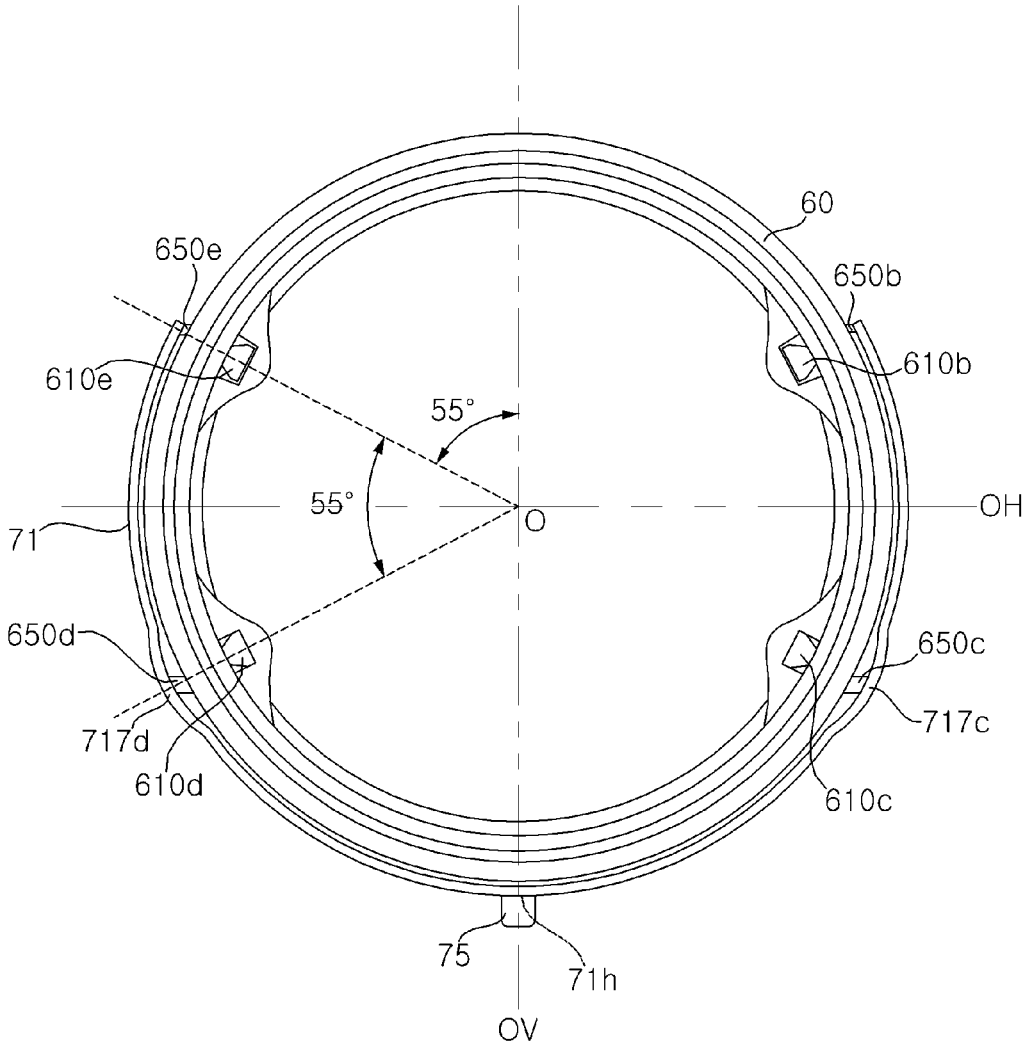
FIG. 5 is a rear view of FIG. 4.
Figure 6:
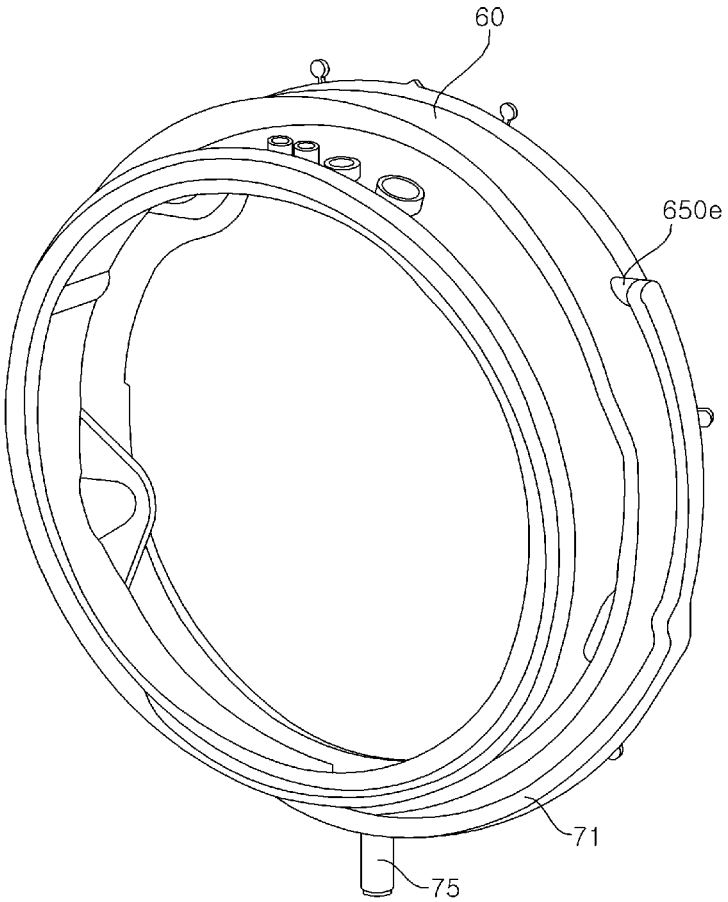
FIG. 6 is a perspective view of FIG. 4.
Figure 7:
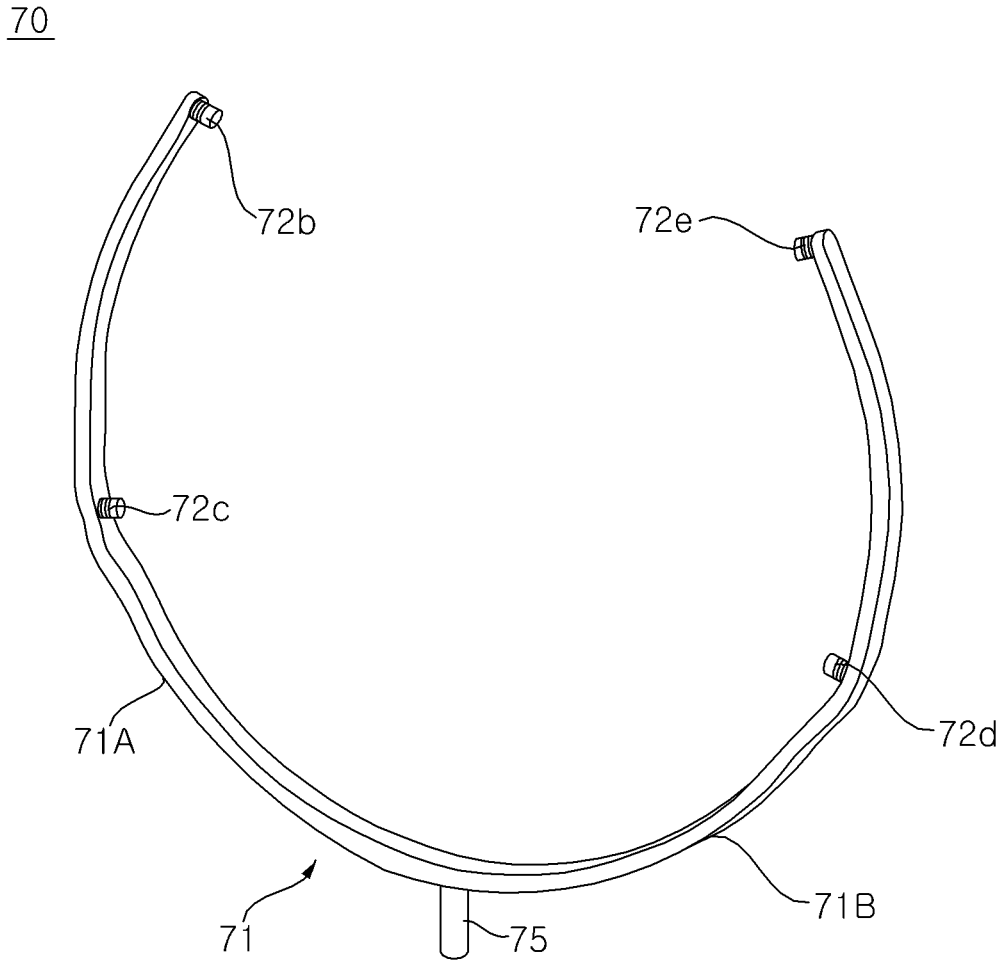
FIG. 7 is a perspective view illustrating a nozzle water supply conduit shown in FIG. 4 to FIG. 6.

FIG. 4 is a view excluding a balancer in FIG. 3, FIG. 5 is a rear view of FIG. 4, FIG. 6 is a perspective view of FIG. 4, and FIG. 7 is a perspective view illustrating a nozzle water supply conduit shown in FIG. 4 to FIG. 6. Referring to FIG. 4 to FIG. 7, the gasket 60 includes a plurality of nozzles 610*b*, 610*c*, 610*d*, and 610*e* for spraying the circulating water into the drum 32. A plurality of nozzles 610*b*, 610*c*, 610*d*, and 610*e* may be formed in the inner circumferential portion of the gasket 60.

The nozzle water supply conduit 70 guides the circulating water pumped by the pump 36 to the plurality of nozzles 610*b*, 610*c*, 610*d* and 610*e*, and is fixed to the gasket 60. A plurality of port insertion conduits 650*b*, 650*c*, 650*d*, and 650*e* respectively extended from the plurality of nozzles 610*b*, 610*c*, 610*d*, and 610*e* are protruded from the outer circumferential surface of the gasket 60. Each of the port insertion conduits 650*b*, 650*c*, 650*d*, and 650*e* may communicate with the respective nozzles 610*b*, 610*c*, 610*d*, and 610*e*.

The nozzle water supply conduit 70 may be coupled to the plurality of port insertion conduits 650*b*, 650*c*, 650*d* and 650*e* to communicate with the plurality of nozzles 610*b*, 610*c*, 610*d* and 610*e*.

The nozzle water supply conduit 70 may include a transfer conduit 71 (or a flow conduit) for guiding the water supplied through the circulation conduit 18, and a plurality of nozzle water supply ports 72*b*, 72*c*, 72*d*, and 72*e* protruded from the transfer conduit 71. The plurality of nozzle water supply ports 72*b*, 72*c*, 72*d* and 72*e* are press-fitted into the plurality of port insertion conduits 650*b*, 650*c*, 650*d* and 650*e* and pressed into the gasket 60, so that the nozzle water supply conduit 70 can be provided on the outer circumferential surface of the gasket 60.

The upper portion of the transfer conduit 71 may be formed to be open. The transfer conduit 71 is disposed around the outer circumferential portion of the gasket 60, and is connected to the pump 36 through the circulation conduit 18. Each of the nozzle water supply ports 72*b*, 72*c*, 72*d* and 72*e* protrudes inward along the radial direction from the transfer conduit 71, and passes through the gasket 60 to supply the circulating water to a corresponding nozzle 610*b*, 610*c*, 610*d* and 610*e*.

The nozzle water supply conduit 70 may include a circulation conduit connection port 75 which protrudes from the transfer conduit 71 and is connected to the circulation conduit 18. The circulation conduit connection port 75 may protrude outward along the radial direction from the transfer conduit 71.

The circulation conduit connection port 75 is connected to the transfer conduit 71 below any one of the plurality of nozzles 610*b*, 610*c*, 610*d*, and 610*e*. Preferably, the circulation conduit connection port 75 is connected to the lowermost point of the transfer conduit 71. That is, the transfer conduit 71 may be positioned in the lowermost point of the inlet port 71*h* through which water is introduced from the circulation conduit connection port 75.

The transfer conduit 71 includes a first conduit 71A and a second conduit 71B. The first conduit 71A extends from the circulation conduit connection port 75 in a first direction and is connected to any two or more nozzle water supply ports 72*b* and 72*c* of the plurality of nozzle water supply ports 72*b*, 72*c*, 72*d*, and 72*e*. The second conduit 71B extends in a second direction from the circulation conduit connection port 75 and is connected to the other two or more nozzle water supply ports 72*d* and 72*e* of the plurality of nozzle water supply ports 72*b*, 72*c*, 72*d*, and 72*e*.

One end of each of the first conduit 71A and the second conduit 71B is fluid connected with the circulation conduit connection port 75, and the other end of the first conduit 71A and the other end of the second conduit 71B are closed.

The plurality of nozzles 610*b*, 610*c*, 610*d*, and 610*e* may include a pair of upper nozzles 610*b* and 610*e* which spray circulating water downward, and a pair of lower nozzles 610*c* and 610*d* which are disposed below the pair of upper nozzles 610*b* and 610*e*, and spray circulating water upward.

The pair of upper nozzles 610*b* and 610*e* may be formed above the inlet port 71*h*, and may be disposed in both the left and right sides based on the inlet port 71*h*. The pair of upper nozzles 610*b* and 610*e* may be disposed symmetrically with respect to the vertical line OV passing through the center O of the transfer conduit 71 (see FIG. 5). Therefore, the upper nozzles 610*b* and 610*e*, Is also symmetrical with respect to the vertical line (OV). The spray directions of the respective upper nozzles 610*b* and 610*e* are also symmetrical with respect to the vertical line OV.

The pair of upper nozzles 610*b* and 610*e* may be positioned above the center O of the gasket 60 (for reference, OH shown in FIG. 6 is a horizontal line passing through the center O). Since each of the upper nozzles 610*b* and 610*e* sprays the circulating water downward, when the drum 32 is viewed from the front, the circulating water passes through an area above the center C of the drum 32 at the inlet side of the drum 32, and is sprayed in a downwardly inclined manner as it penetrates deeply into the drum 32.

The pair of lower nozzles 610*c* and 610*d* are disposed above the inlet port 71*h*, but below the pair of upper nozzles 610*b* and 610*e*. The pair of lower nozzles 610*c* and 610*d* may be disposed in the left and right sides based on the inlet port 71*h*, and preferably, disposed symmetrically with respect to the vertical line OV so that the spray directions of the lower nozzles 610*c*, 610*d* are symmetrical with respect to the vertical line OV.

The pair of lower nozzles 610*c* and 610*d* may be positioned below the center O of the gasket 60. Since each of the lower nozzles 610*c* and 610*d* sprays the circulating water upward, when the drum 32 is viewed from the front, the circulating water passes through an area below the center C of the drum 32 at the inlet side of the drum 32, and is sprayed in a upwardly inclined manner as it penetrates deeply into the drum 32.

Meanwhile, the transfer conduit 71 may include a plurality of protrusions 717*c* and 717*d* which are convex outwardly in the radial direction in comparison with the circumferential portion. The protrusions 717*c* and 717*d* may be formed in positions corresponding to a plurality of nozzle inflow conduits 611, and are convex in a direction away from the outer circumferential portion of the gasket 60. The nozzle water supply ports 72*c* and 72*d* may protrude from respective protrusions 717*c* and 717*d*.

The circulating water supplied through the circulation conduit 18 flows into the transfer conduit 71 through the circulation conduit connection port 75, and then is branched into the first conduit 71A and the second conduit 71B to ascend along a flow path, and is started to be sprayed from the lower nozzles 610*c* and 610*d* to the upper nozzles 610*b* and 610*e* sequentially. The operating pressure of the pump 36 may be controlled to such an extent that the pumped water can reach the upper nozzles 610*b* and 610*e*.

The controller controls the speed of the pump motor so that the spray pressure of the nozzles 610*b*, 610*c*, 610*d*, and 610*e* can be discriminated. As one embodiment of such a spray pressure control, the speed of the pump motor can be variably controlled within a range in which spray is simultaneously performed by all of the nozzles 610*b*, 610*c*, 610*d*, and 610*e*. When the circulating water is sprayed by the nozzles 610*b*, 610*c*, 610*d*, and 610*e*, a filtration motion in which laundry is rotated together with the drum 32 while the laundry is adhered to the inner surface of the drum 32 may be performed.

The filtration motion may be performed a plurality of times. The acceleration of the pump motor may be synchronized with the execution time point of each of the filtration motions, and the deceleration may be synchronized with the time point of braking the drum 32 for the termination of each filtration motion.

That is, when the drum 32 starts to be accelerated for the filtration motion, the pump motor is also accelerated. Accordingly, when the laundry is completely attached to the drum 32 and rotated together with the drum 32 (i.e., a state where even when the laundry reaches the apex due to the rotation of the drum 32, the centrifugal force is greater than the gravity so that the laundry does not fall), the spray pressure through the nozzles 610*b*, 610*c*, 610*d*, and 610*e* can be maximized. When the rotation speed of the pump motor is maximized while the filtration motion is being performed, the circulating water sprayed from the nozzles 610*b*, 610*c*, 610*d*, and 610*e* reaches deepest into the drum 32. Particularly, the circulating water sprayed through the upper nozzle 610*b* and 610*e* can reach the deepest portion of the drum 32 in comparison with the lower nozzle 610*c* and 610*d*.

When the upper nozzle 610*b* and 610*e* forms an angle θ1 for the vertical line OV and the lower nozzle 610*c* and 610*d* forms an angle θ2 for the upper nozzle 610*c* and 610*d*, with respect to the center O of the gasket 60 (or the center of the nozzle water supply conduit 70), θ1 may be approximately 50 degrees to 60 degrees, preferably, 55 degrees as shown in FIG. 5, but it is not necessarily limited thereto. Further, θ2 is approximately 50 to 65 degrees, preferably, 55 degrees as shown in FIG. 5, but it is not necessarily limited thereto.

The transfer conduit 71 is formed in an annular shape having an open top. The plurality of nozzle water supply ports 72*b*, 72*c*, 72*d* and 72*e* include a pair of upper nozzle water supply ports 72*b* and 72*e* and a pair of lower nozzle water supply ports 72*c* and 72*d*.

The pair of upper nozzle water supply ports 72*b* and 72*e* are positioned below the closed other ends of the first conduit 71A and the second conduit 71B, and are disposed in the left and right sides respectively based on the circulation conduit connection port 75. The pair of upper nozzle water supply ports 72*b* and 72*e* are positioned above the center of the gasket 60.

The pair of lower nozzle water supply ports 72*c* and 72*d* are disposed below the pair of upper nozzle water supply ports 72*b* and 72*e*, and disposed in the left and right sides respectively based on the circulation conduit connection port 75. The pair of lower nozzle water supply ports 72*c* and 72*d* are disposed above the inlet port 71*h* and disposed below the center of the gasket 60.

The plurality of port insertion conduits 650*b*, 650*c*, 650*d*, and 650*e* include a pair of upper port insertion conduits 650*b* and 650*e* and a pair of lower port insertion conduits 650*c* and 650*d*. The upper nozzle water supply port 72*b* and 72*e* is respectively press-fitted into the upper port insertion conduit 650*b* and 650*e* and the lower nozzle water supply port 72*c* and 72*d* is respectively press-fitted into the lower port insertion conduit 650*c* and 650*e*.

The upper port insertion conduit 650*b* and 650*e* is positioned above the center O of the gasket 60, and is disposed in both sides based on the inlet port 71*h* of the transfer conduit 71. The upper port insertion conduits 650*b* and 650*e* are symmetrical based on the vertical line OV.

The lower port insertion conduit 650*c* and 650*e* is positioned below the center O of the gasket 60, disposed above the inlet port of the transfer conduit 71, and disposed in both sides based on the inlet port 71*h*. The lower port insertion conduits 650*c* and 650*e* are symmetrical based on the vertical line OV.

Figure 8:
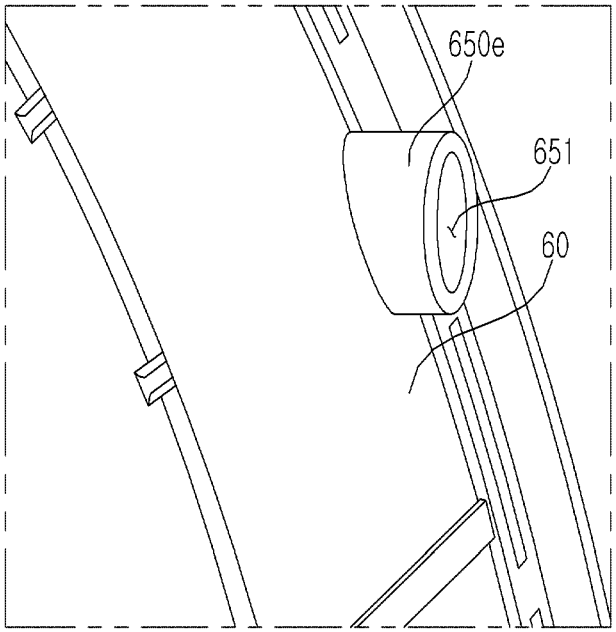
FIG. 8 is a perspective view illustrating a port insertion conduit shown in FIG. 4 to FIG. 6.
Figure 9:
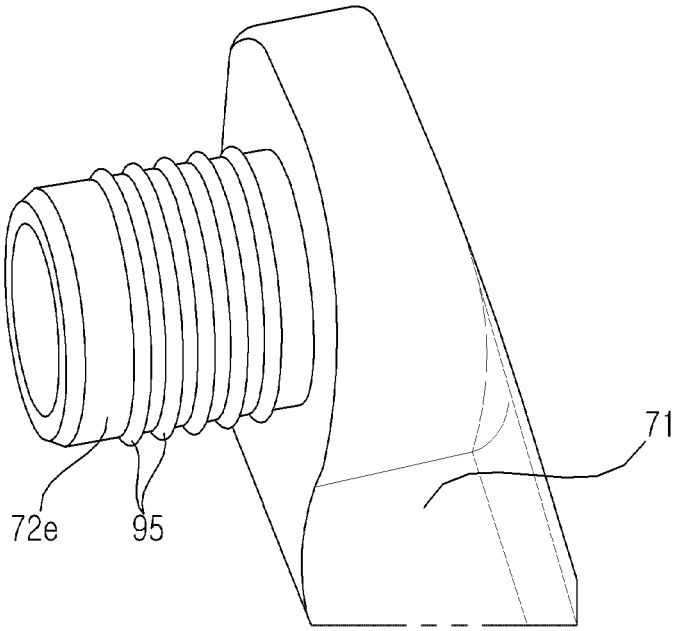
FIG. 9 is a perspective view illustrating a nozzle water supply port shown in FIG. 7.
Figure 10:
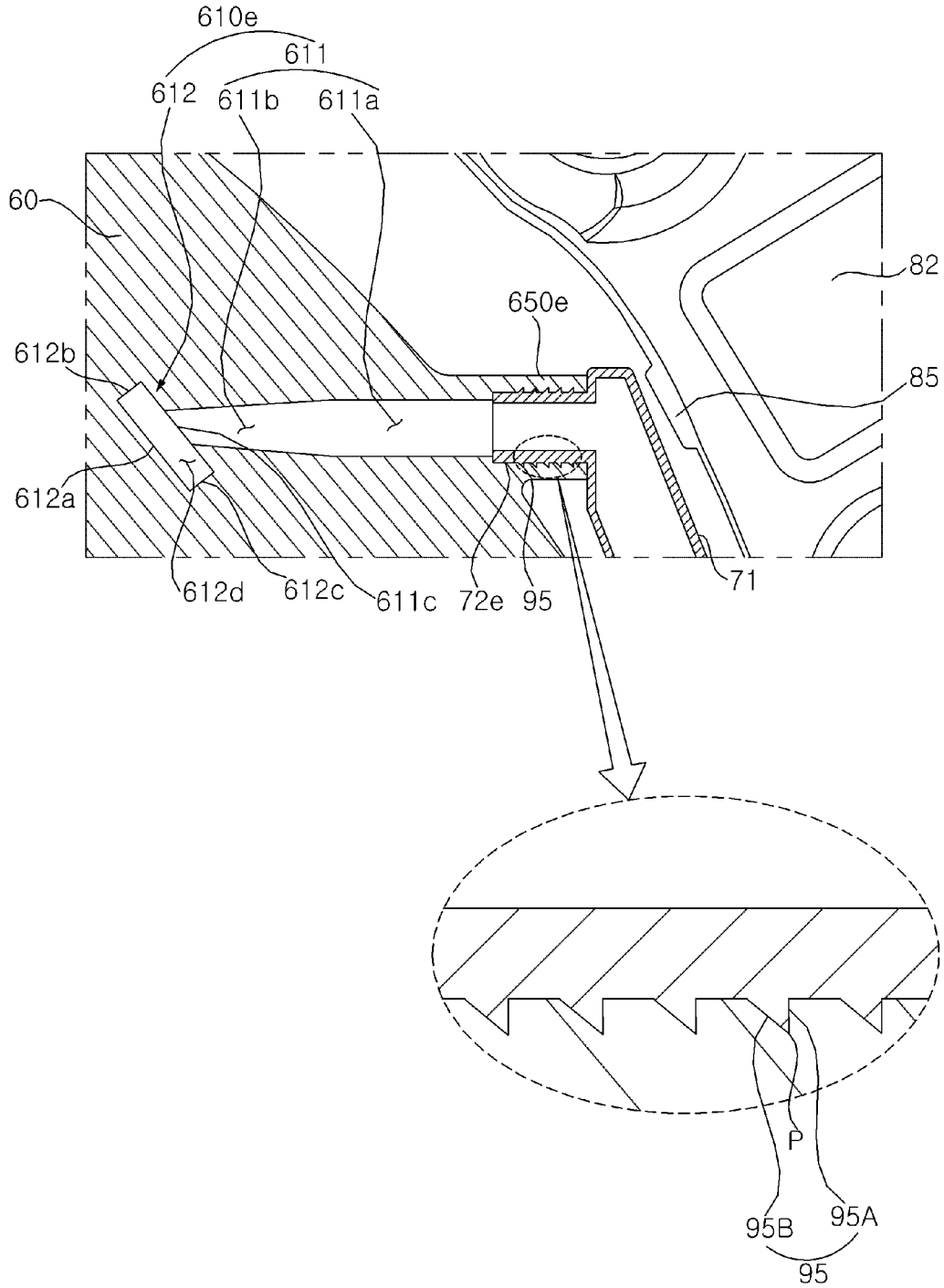
FIG. 10 is an enlarged view of part A divided by a dotted line in FIG. 3, and is a sectional view of a gasket and a nozzle water supply conduit.

FIG. 8 is a perspective view illustrating a port insertion conduit shown in FIG. 4 to FIG. 6, FIG. 9 is a perspective view illustrating a nozzle water supply port shown in FIG. 7, and FIG. 10 is an enlarged view of part A divided by a dotted line in FIG. 3, and is a sectional view of a gasket and a nozzle water supply conduit. Here, since the plurality of nozzles 610*b*, 610*c*, 610*d*, and 610*e* are formed in the same structure, only the nozzle 610*e* is shown. In addition, since the plurality of port insertion conduits 650*b*, 650*c*, 650*d*, and 650*e* are formed in the same structure, only the port insertion conduit 650*e* extended from the nozzle 610*e* is shown. In addition, since the plurality of nozzle water supply ports 72*b*, 72*c*, 72*d*, and 72*e* are formed in the same structure, only the nozzle water supply port 72*e* press-fitted into the port insertion conduit 650*e* is shown. Thus, in the following description, the nozzle 610*e* may be interpreted as each of the plurality of nozzles 610*b*, 610*c*, 610*d*, and 610*e*, the port insertion conduit 650*e* may be interpreted as each of the plurality of port insertion conduits 650*b*, 650*c*, 650*d*, and 650*e*, and the nozzle water supply port 72*e* may be interpreted as each of the plurality of nozzle water supply ports 72*b*, 72*c*, 72*d*, and 72*e*.

Referring to FIG. 8 and FIG. 10, the nozzle water supply port 72*e* is inserted into an inlet 651 formed in the port insertion conduit 650*e* and is coupled to the gasket 60. It is preferable that the outer diameter of the nozzle water supply port 72*e* is formed larger than the diameter of the inlet 651 so that the nozzle water supply port 72*e* can be inserted into the inlet 651 formed in the port insertion conduit 650*e* and coupled to the gasket 60. Here, since the inlet 651 is interpreted as the inner diameter of the port insertion conduit 650*e*, it is preferable that the outer diameter of the nozzle water supply port 72*e* is formed larger than the inner diameter of the port insertion conduit 650*e*.

A press-fit protrusion 95 is formed on the outer circumferential surface of the nozzle water supply port 72*e*. The press-fit protrusion 95 is formed in a ring shape extended along the circumferential direction on the outer circumferential surface of the nozzle water supply port 72*e*. A plurality of press-fit protrusions 95 may be formed along the longitudinal direction of the nozzle water supply port 72*e*. Although five press-fit protrusions 95 of the present embodiment are formed along the longitudinal direction of the nozzle water supply port 72*e*, the number of the press-fit protrusions 95 formed in the nozzle water supply port 72*e* is not limited thereto.

The nozzle water supply port 72*e* is inserted into the inlet 651 formed in the port insertion conduit 650*e* and is coupled to the port insertion conduit 650*e*. At this time, the press-fit protrusion 95 may be press-fitted in the radial direction while being in close contact with the inner circumferential surface of the port insertion conduit 650*e*.

Since the gasket 60 is formed of a material having an elastic force, the press-fit protrusion 95 elastically deforms the inner circumferential surface of the port insertion conduit 650*e* while being in close contact with the inner circumferential surface of the port insertion conduit 650*e*, and may be press-fitted to the inner circumferential surface in the radial direction.

When the direction in which the nozzle water supply port 72*e* is inserted into the port insertion conduit 650*e* is defined as a front direction, the rear surface of the press-fit protrusion 95 is formed to be a vertical surface, and a front surface extended in the front direction from the vertical surface is formed to be an inclined surface having a gentler slope than the vertical surface. That is, the press-fit protrusion 95 includes a first surface 95A which is protruded outward along the radial direction from the outer circumference of the nozzle water supply port 72*e* to a certain point P and is perpendicular to the outer circumference of the nozzle water supply port 72*e*, and a second surface 95B which is extended from the certain point P to the outlet side of the nozzle water supply port 72*e* and extended closer to the outer circumference of the nozzle water supply port 72*e*. Thus, when the nozzle water supply port 72*e* is press-fitted into the inlet 651 formed in the port insertion conduit 650*e*, the second surface 95B, which is the inclined surface, facilitates the press-fitting. After the press-fitting is completed, the first surface 95A, which is the vertical surface, prevents the nozzle water supply port 72*e* from easily escaping from the port insertion conduit 650*e*.

Further, since the nozzle water supply conduit 70 can be coupled to the gasket 60 without using a binding member (e.g., a clamp), a time required for the operation for tightening the binding member is not required.

Since it is not necessary to fasten the binding member to the outer circumferential surface of the port insertion conduit 650*e* after the nozzle water supply port 72*e* is press-fitted into the port insertion conduit 650*e*, it is possible to reduce the length of the port insertion conduit 650*e*, thereby reducing the resistance of the flow path of water due to the length of the port insertion conduit 650*e*.

In addition, due to the short length of the port insertion conduit 650*e*, when the nozzle water supply port 72*e* is completely press-fitted into the port insertion conduit 650*e*, the transfer conduit 71 is not bent convexly outwardly, so that the resistance of the flow path of the water flowing in the transfer conduit 71 can be reduced. Further, due to the short length of the port insertion conduit 650*e*, a space in which the nozzle water supply conduit 70 can be disposed can be secured between the gasket 60 and the balancer 81 and 82, and the balancer 81 and 82 having a large volume can be provided in this secured space.

The nozzle 610*e* may include a nozzle inflow conduit 611 protruding to the inside of the gasket 60 and a nozzle head 612 connected to the nozzle inflow conduit 611. The nozzle inflow conduit 611 has a cylindrical shape and protrudes from the inner circumferential surface of the outer diameter portion 65*b* and may be connected to a corresponding nozzle head 612. The nozzle inflow conduit 611 may communicate with the port insertion conduit 650*e*. The nozzle head 612 may form an outlet 612*d*, on the rear surface, for spraying water into the drum.

The port insertion conduit 650*e* protrudes from the outer circumferential portion of the gasket 60, at a position corresponding to the nozzle inflow conduit 611. The port insertion conduit 650*e* communicates with the nozzle inflow conduit 611, and the nozzle water supply port 72*e* is inserted into the port insertion conduit 650*e*. The circulating water discharged from the nozzle water supply port 72*e* is supplied to the nozzle head 612 through the nozzle inflow conduit 611.

The port insertion conduit 650*e* and the nozzle inflow conduit 611 are extended substantially in the same line. The longitudinal direction of the nozzle inflow conduit 611 is disposed roughly horizontally, not toward the center O of the gasket 60. Therefore, the nozzle inflow conduit 611 does not guide the water toward the center of the gasket 60 but guides the water in a horizontal direction.

The nozzle head 612 may include a collision surface 612*a* with which water discharged from the outlet 611*c* of the nozzle inflow conduit 611 collides, a left side surface 612*b* which extends from the left side of the collision surface 612*a* and defines a left boundary of the water flow that flows along the collision surface 612*a*, and a right side surface 612*c* which extends from the right side of the collision surface 612*b* and defines a right boundary of the water flow that flows along the collision surface 612*a*. The collision surface 612*a*, the left side surface 612*b*, and the right side surface 612*c* extend to the outlet 612*d* of the nozzle head 612. The collision surface 612*a* of the nozzle head 612 may face the outlet 611*c* of the nozzle inflow conduit 611, and may be formed to be inclined toward the center O of the gasket 60.

Thus, the longitudinal direction of the nozzle inflow conduit 611 is disposed roughly horizontally without facing the center O of the gasket 60 so that the water is guided in a horizontal direction. At this time, only the collision surface 612*a* of the nozzle head 612 is formed inclined toward the center O of the gasket 60. Therefore, the water, which flows through the nozzle inflow conduit 611 and is guided to the nozzle head 612, is less influenced by gravity, and the spray shape of the water sprayed into the drum 32 from the plurality of nozzles 610*b*, 610*c*, 610*d*, and 610*e* may be maintained uniformly.

If the longitudinal direction of the nozzle inflow conduit 611 is not disposed roughly horizontally and is disposed toward the center O of the gasket 60, the water flowing through the nozzle inflow conduit 611 of the upper nozzle 610*b* and 610*e* is sprayed into the drum 32 faster than the lower nozzle 610*c* and 610*d* as gravity is applied to the water flowing downward, and the water flowing through the nozzle inflow conduit 611 of the lower nozzle 610*c* and 610*d* is sprayed into the drum 32 slower than the upper nozzle 610*b* and 610*e* as gravity is applied to the water flowing upward. Therefore, it is difficult to uniformly maintain the spray shape of the water sprayed into the drum 32 from the plurality of nozzles 610*b*, 610*c*, 610*d*, and 610*e*. However, in the present embodiment, the longitudinal direction of the nozzle inflow conduit 611 is disposed roughly horizontally to guide the water in the horizontal direction, so that the spray shape of the water sprayed into the drum 32 from the plurality of nozzles 610*b*, 610*c*, 610*d*, and 610*e* can be uniformly maintained.

The nozzle inflow conduit 611 may include an inlet portion 611*a* and an outlet portion 611*b*. The inlet portion 611*a* is extended by a certain length with the same diameter as the inlet 651 of the port insertion conduit 650*e*, from the inlet 651 of the port insertion conduit 650*e* into which the nozzle water supply port 72*e* is inserted. The outlet portion 611*b* is extended in the longitudinal direction from the inlet portion 611*a* and connects the inlet portion 611*a* and the nozzle head 612. The diameter of the outlet portion 611*b* decreases from the inlet portion 611*a* toward the nozzle head 612. The diameter of the inlet portion 611*a* is formed to be the same as the diameter of the inlet 651 so that the water discharged from the nozzle water supply port 72*e* receives less resistance at the inlet portion 611*a* to reduce the flow path resistance. The outlet 611*c* of the outlet portion 611*b* is formed to have the smallest diameter so that high pressure water can be discharged to the nozzle head 612.

Meanwhile, the transfer conduit 71 of the nozzle water supply conduit 70 is disposed between the outer circumferential surface of the gasket 60 and the balancer 81 and 82. As the transfer conduit 71 is disposed between the outer circumferential surface of the gasket 60 and the balancer 81 and 82, the nozzle water supply conduit 70 can be installed in the existing space without securing a separate space.

The transfer conduit 71 includes the protrusions 717*c* and 717*d* as described above, and the protrusion 717*c* and 717*d* is formed to be convex toward the balancer 81 and 82 in a position corresponding to the lower nozzle water supply ports 72*c* and 72*d* respectively. As the protrusion 717*c* and 717*d* is formed to be convex toward the balancer 81 and 82 in a position corresponding to the lower nozzle water supply ports 72*c* and 72*d* respectively, when the lower nozzle water supply port 72*c* and 72*d* attempts to escape from the port insertion conduit 650*c* and 650*d* of the gasket 60, the protrusion 717*c* and 717*d* comes into contact with the balancer 81 and 82 to prevent the lower nozzle water supply ports 72*c* and 72*d* from moving, thereby preventing the lower nozzle water supply port 72*c* and 72*d* from being separated.

However, since the transfer conduit 71 is formed in an annular shape having an open top, it is difficult to form a structure like the protrusion 717*c* and 717*d* in the upper end of the transfer conduit 71. Therefore, in order to prevent the upper nozzle water supply port 72*b* and 72*e* from being separated from the port insertion conduit 650*b* and 650*e*, the balancer 81 and 82 is provided with a separation preventing rib 85 for preventing the nozzle water supply port 72*b* and 72*e* from being separated, and the separation preventing rib is protruded from a position corresponding to the upper nozzle water supply ports 72*b* and 72*e*. The separation preventing rib 85 is protruded from the inside of the balancer 81 and 82 toward a portion where the upper nozzle water supply port 72*b* and 72*e* is formed in the transfer conduit 71, and is spaced apart from the transfer conduit 71. When the upper nozzle water supply port 72*b* and 72*e* attempts to escape from the port insertion conduit 650*b* and 650*e* of the gasket 60, the transfer conduit 71 is brought into contact with the separation preventing rib 85 to prevent the upper nozzle water supply port 72*b* and 72*e* from moving, so that the upper nozzle water supply ports 72*b* and 72*e* can be prevented from being separated.

As described above, the washing machine according to the present invention has the following effects.

First, since the nozzle water supply port is press-fitted into the gasket, a binding member for coupling the nozzle water supply conduit to the gasket is not required, so that the time required for the operation for tightening the binding member is not required.

Second, since the press-fit protrusion press-fitted into the gasket is formed on the outer circumferential surface of the nozzle water supply port, it is possible to prevent the nozzle water supply port from escaping from the gasket when the nozzle water supply port is press-fitted into the gasket to complete the coupling.

Third, since it is not necessary to fasten the binding member to the outer circumferential surface of the port insertion conduit after the nozzle water supply port is press-fitted into the port insertion conduit, it is possible to reduce the length of the port insertion conduit, thereby reducing the resistance of the flow path of water due to the length of the port insertion conduit. Further, a space in which the nozzle water supply conduit can be disposed can be secured between the gasket and the balancer disposed on the front surface of the tub, and the balancer having a large volume can be provided in this secured space. In addition, due to the short length of the port insertion conduit, the transfer conduit is not bent outwardly, so that the resistance of the flow path of the water flowing in the transfer conduit can be reduced.

Fourth, since the nozzle inflow conduit does not guide the water toward the center of the gasket but guides the water in the horizontal direction, the water that flows through the nozzle inflow conduit and is guided to the nozzle head is less influenced by gravity so that the spraying shape of the water that is sprayed from the plurality of nozzles into the drum can be maintained uniformly.

Fifth, since the balancer installed on the front surface of the tub is provided with a separation preventing rib formed in a position corresponding to the upper nozzle water supply port, the separation preventing rib prevents the upper nozzle water supply port from escaping from the gasket.

Sixth, since the transfer conduit is provided with a protrusion convexly formed toward the balancer in a position corresponding to the lower nozzle water supply port, the protrusion prevents the lower nozzle water supply port from escaping from the gasket.

Hereinabove, although the present invention has been described with reference to exemplary embodiments and the accompanying drawings, the present invention is not limited thereto, but may be variously modified and altered by those skilled in the art to which the present invention pertains without departing from the spirit and scope of the present invention claimed in the following claims.

The invention claimed is:

1. A washing machine comprising:

a casing having a case opening defined at a front surface of the casing;

a tub disposed in the casing, the tub having a tub opening defined at a front surface of the tub;

a drum disposed in the tub;

a pump configured to circulate water within the washing machine;

a gasket arranged between the case opening and the tub opening, the gasket comprising an inner circumferential surface that communicates the case opening with the tub opening;

a first plurality of nozzles located at a first side of the inner circumferential surface of the gasket;

a first plurality of port insertion pipes that are defined at the gasket and that communicate with the first plurality of nozzles;

a balancer provided at the front surface of the tub and disposed outside of the gasket; and a water pipe assembly that comprises:

an inlet hole connected to the pump, a first conduit that is disposed radially between the gasket and the balancer along a radial direction of the drum such that the gasket, the first conduit, and the balancer are arranged along a line extending in the radial direction, the first conduit extending along a first outer surface of the gasket from the inlet hole, and a first plurality of nozzle supply ports that protrude from the first conduit toward the gasket and that are inserted into the first plurality of port insertion pipes.

2. The washing machine of claim 1, wherein each of the first plurality of nozzles comprises:

a nozzle inflow pipe that communicates with a corresponding port insertion pipe among the first plurality of port insertion pipes and that extends from an outer circumferential surface of the gasket to the inner circumferential surface of the gasket; and a nozzle head that is connected to the nozzle inflow pipe and that forms an outlet for spraying water into the drum.

3. The washing machine of claim 2, wherein the nozzle head comprises:

a collision surface disposed at the outlet of the nozzle head and configured to collide with water discharged from one of the first plurality of nozzle supply port.

4. The washing machine of claim 2, wherein the nozzle inflow pipe comprises:

an inlet portion that extends a first length from an inlet of the corresponding port insertion pipe towards an interior of the gasket, and having a diameter corresponding to the inlet of the corresponding port insertion pipe; and an outlet portion that connects the inlet portion and the nozzle head, and having a diameter that decreases in a direction from the inlet portion toward the nozzle head.

5. The washing machine of claim 1, wherein the first plurality of nozzle supply ports are disposed at a first lateral side of the gasket, the first plurality of nozzle supply ports comprising a first upper nozzle supply port disposed below a closed end of the first conduit and a first lower nozzle supply port disposed below the first upper nozzle supply port.

6. The washing machine of claim 5, wherein the first upper nozzle supply port is disposed between the balancer and the gasket.

7. The washing machine of claim 5, wherein the first conduit has an uplifted portion thereof that protrudes in an outward direction away from an outer circumference of the gasket.

8. The washing machine of claim 1, wherein the first plurality of nozzles are disposed at a first lateral side of the gasket, the first plurality of nozzles comprising a first upper nozzle disposed above a radial center of the gasket and a first lower nozzle disposed below the radial center of the gasket.

9. The washing machine of claim 1, wherein each of the first plurality of port insertion pipes of the gasket protrudes outward from an outer circumferential surface of the gasket.

10. The washing machine of claim 1, wherein the first outer surface of the gasket is a part of an outer circumferential surface of the gasket, and wherein the first conduit extends along the outer circumferential surface of the gasket in a first circumferential direction of the gasket.

11. The washing machine of claim 2, wherein the nozzle inflow pipe extends in a horizontal direction.

12. The washing machine of claim 9, wherein the first plurality of port insertion pipes extend in a horizontal direction.

13. The washing machine of claim 1, wherein one of the first plurality of port insertion pipes and another of the first plurality of port insertion pipes extend parallel to each other.

14. The washing machine of claim 1, wherein each of the first plurality of nozzle supply ports comprises at least one press-fit protrusion that is disposed at an outer circumferential surface of the nozzle supply port.

15. The washing machine of claim 1, wherein the first conduit includes a first portion that extends from one of the first plurality of nozzle supply ports to another of the first plurality of nozzle supply ports along the first outer surface of the gasket.

16. The washing machine of claim 15, further comprising:

a second plurality of nozzles located at a second side of the inner circumferential surface of the gasket; and a second plurality of port insertion pipes that are defined at the gasket and that communicate with the second plurality of nozzles, wherein the water pipe assembly further comprises:

a second conduit that extends along a second outer surface of the gasket, and a second plurality of nozzle supply ports that protrude from the second conduit toward the gasket and that are inserted into the second plurality of port insertion pipes, and wherein the second conduit includes a second portion that extends from one of the second plurality of nozzle supply ports to another of the second plurality of nozzle supply ports along the second outer surface of the gasket.

17. The washing machine of claim 16, wherein the balancer comprises:

a first balancer disposed outside of the first outer surface of the gasket; and a second balancer disposed outside of the second outer surface of the gasket, and wherein the first conduit is disposed between the first balancer and the first outer surface of the gasket, and the second conduit is disposed between the second balancer and the second outer surface of the gasket.

18. The washing machine of claim 17, wherein the water pipe assembly further comprises a connection port that protrudes from a circumference of the inlet hole and that is disposed between the first balancer and the second balancer.

19. The washing machine of claim 18, further comprising a circulation pipe that connects the pump and the connection port.

20. The washing machine of claim 18, wherein the first conduit extends from the connection port in a first direction along the first outer surface of the gasket, and wherein the second conduit extends from the connection port in a second direction along the second outer surface of the gasket.

21. The washing machine of claim 6, wherein the balancer comprises a first separation preventing rib that protrudes from the balancer toward the first upper nozzle supply port, the first separation preventing rib being configured to prevent separation between the first upper nozzle supply port and one of the plurality of first port insertion pipes that receives the first upper nozzle supply port.

22. The washing machine of claim 7, wherein the first lower nozzle supply port protrudes from the uplifted portion.

* * * * *